US008322255B1

(12) United States Patent
Jordan et al.

(10) Patent No.: US 8,322,255 B1
(45) Date of Patent: Dec. 4, 2012

(54) MULTI-WRENCH GEAR HEAD APPARATUS FOR ADJUSTING VEHICLE TIE-RODS

(75) Inventors: Doug Jordan, Irondale, AL (US); Jeff Nisbett, Anniston, AL (US)

(73) Assignee: Honda Motor Co., Ltd., Tokyo (JP)

( * ) Notice: Subject to any disclaimer, the term of this patent is extended or adjusted under 35 U.S.C. 154(b) by 237 days.

(21) Appl. No.: 12/694,029

(22) Filed: Jan. 26, 2010

(51) Int. Cl.
*B25B 17/00* (2006.01)

(52) U.S. Cl. ..... 81/57.14; 81/476; 81/57.22; 81/57.32; 81/57.31; 81/57.3

(58) Field of Classification Search ..... 81/57.14, 81/57.3, 57.22, 57.32, 57.36, 57.31
See application file for complete search history.

(56) References Cited

U.S. PATENT DOCUMENTS

| | | | | |
|---|---|---|---|---|
| 2,482,387 | A * | 9/1949 | Veneman | 81/476 |
| 2,556,536 | A * | 6/1951 | Harris | 81/55 |
| 3,535,960 | A * | 10/1970 | Borries | 81/57.14 |
| 3,783,955 | A | 1/1974 | Gill | |
| 4,171,651 | A | 10/1979 | Dacunto | |
| 4,674,366 | A | 6/1987 | Lauer et al. | |
| 4,679,327 | A | 7/1987 | Fouchey et al. | |
| 4,928,558 | A * | 5/1990 | Makhlouf | 81/57.3 |
| 4,942,794 | A | 7/1990 | Snyder et al. | |
| 5,040,303 | A * | 8/1991 | Koerner | 33/286 |
| 6,308,593 | B1 | 10/2001 | Shibayama et al. | |
| 7,062,992 | B2 | 6/2006 | Spirer | |
| 7,089,827 | B2 | 8/2006 | Wexler | |
| 7,357,053 | B2 * | 4/2008 | Doan | 81/57.14 |
| 2006/0108131 | A1 | 5/2006 | Osada et al. | |
| 2009/0100972 | A1 | 4/2009 | Hoenke | |
| 2009/0260488 | A1 | 10/2009 | Kanazawa et al. | |

FOREIGN PATENT DOCUMENTS

| | | | |
|---|---|---|---|
| DE | 3718087 | A1 | 12/1987 |
| JP | 2004-351603 | A | 12/2004 |

OTHER PUBLICATIONS

Johannes Lübbering GMBH, Lübbering Product Catalog, 182 pages, V09.001.

* cited by examiner

*Primary Examiner* — Monica Carter
*Assistant Examiner* — Melanie Alexander
(74) *Attorney, Agent, or Firm* — Standley Law Group LLP

(57) ABSTRACT

A multi-wrench gear head apparatus for adjusting tie-rod assemblies of dissimilar size. Such an apparatus employs a plurality of driven wrench (socket) portions, which can be provided to engage and adjust tie-rods of different and particular sizes. The wrench portions share a common gear train, such that multiple wrench portions may be driven by a single drive means.

22 Claims, 7 Drawing Sheets

MULTI-WRENCH GEAR HEAD APPARATUS FOR ADJUSTING VEHICLE TIE-RODS

TECHNICAL FIELD

The present invention is directed to an apparatus for adjusting vehicle tie-rods. More particularly, the present invention is directed to a powered gear head equipped with multiple wrench elements that can be used to adjust tie-rods of different sizes.

BACKGROUND

As would be well known to one of skill in the art, the toe angle of a vehicle wheel is typically set during the vehicle manufacturing process. The toe angle is typically set by adjusting a tie-rod assembly associated with the wheel of interest. A tie-rod assembly commonly extends between the vehicle's steering assembly and a steering arm or similar component associated with each front wheel of the vehicle, such that rotation of the vehicle's steering wheel is translated into a turning of the vehicle's front wheels.

A tie-rod assembly typically includes an inner tie-rod and an outer tie-rod. The inner tie-rod normally threads into a like-threaded portion of the outer tie-rod. Frequently, at least a portion of the inner tie-rod may be of hexagonal or similar cross-section to facilitate rotation during threading of the inner tie-rod into the outer tie-rod. The tie-rod assembly may also include a lock nut that is installed over the threaded portion of the inner tie-rod and may be tightened against the outer tie-rod to secure the position of the tie-rod assembly.

As is common knowledge to one of skill in the art, the toe angle of a vehicle wheel is commonly set by adjusting the overall length of the tie-rod assembly. This is normally accomplished by adjusting the depth to which the inner tie-rod is inserted into the outer tie-rod. Once the proper tie-rod assembly length is achieved, the position of the tie-rods is secured via the lock nut or whatever other locking mechanism is associated with the particular tie-rod assembly of interest.

In order to most efficiently set toe angle during a vehicle manufacturing operation, the tie-rod assembly adjustment process has been automated. For example, it is known in the art to equip a robot with a powered tie-rod adjustment apparatus for this purpose. One such tie-rod adjustment apparatus is described and shown in U.S. Pat. No. 6,308,593 to Shibayama et al. Such a tie-rod adjustment apparatus commonly includes an open-end wrench portion with a driven rotating socket for selectively rotating a hex-shaped portion of an inner tie-rod and a lock nut used to secure the position of the inner tie-rod with respect to the outer tie-rod. A guide fork or similar element may also be provided to engage the outer tie-rod during a toe angle setting process. In operation, the robot appropriately locates the tie-rod adjustment apparatus to the tie-rod assembly and the tie-rod adjustment apparatus is operated to adjust the length of the tie-rod assembly—thereby setting the toe angle of the associated vehicle wheel.

Such tie-rod adjustment apparatus and their methods of use have proven effective in automatic toe angle setting operations. These known devices are not, however, without drawbacks. One particular drawback is associated with the manufacturing of more than one vehicle type on a given assembly line. More particularly, the drawback is associated with the fact that these various vehicle types also frequently employ tie-rod assemblies having dissimilar lock nut and/or inner tie-rod hex sizes. As such, a single tie-rod adjustment apparatus of the typical variety is unable to adjust the tie-rod assemblies of these different vehicles.

One solution to this problem has been to provide a dedicated tie-rod adjustment apparatus for each vehicle type for which a toe angle setting operation will be performed. At the time of vehicle changeover, the robot then performs a tool change, whereby the existing tie-rod adjustment apparatus is disengaged from the robot and the tie-rod adjustment apparatus designed for use with the new vehicle type is engaged.

The undesirable nature of this solution is readily apparent. First, such a solution requires the construction and storage of a number of different tie-rod adjustment apparatus. Further, such apparatus are often quite large and complex, and the need to perform a tool change in between vehicle types may require a temporary slow down or pause of the vehicle assembly line.

Recently, new tie-rod adjustment apparatus designs have been proposed to overcome the aforementioned tool change requirement. These apparatus are allegedly capable of operating on tie-rod assemblies having dissimilar sized components by employing an adjustable tie-rod engaging portion. However, these proposed designs employ highly complex assemblies of moving parts, clamping mechanisms, etc., that invite failure, increase maintenance, and drive up manufacturing costs.

It can be understood from the foregoing discussion that a better solution to operating on tie-rod assemblies having dissimilar sized components is desirable. Apparatus of the present invention provide such a solution.

SUMMARY OF THE GENERAL INVENTIVE CONCEPT

A multi-wrench gear head apparatus of the present invention is able to adjust tie-rod assemblies of dissimilar size without requiring the complex moving parts, clamping assemblies, etc., proposed in other apparatus designed for such a purpose. Instead, a single multi-wrench gear head apparatus of the present invention employs a number wrench portions, which can be provided to engage and adjust tie-rods of different and particular sizes.

More particularly, a multi-wrench gear head apparatus of the present invention includes a plurality of driven wrench portions that are integrated into a single robot end effector. The wrench portions are also driven by a common gear train, such that multiple wrench portions may be operated by a single drive means.

Consequently, during a toe angle setting operation, a robot equipped with a multi-wrench gear head apparatus of the present invention need only select the wrench portion appropriate for the particular tie-rod size and then engage the tie-rod assembly with that wrench portion. A given multi-wrench gear head apparatus of the present invention may include two or more driven wrench portions. The number of wrench portions present may depend on a number of factors including, but not limited to, the number of different vehicle types to be serviced by a single robot and the space constraints associated with the tie-rod areas of the vehicles to be serviced. Therefore, a multi-wrench gear head apparatus of the present invention is not limited to any particular number of wrench portions.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
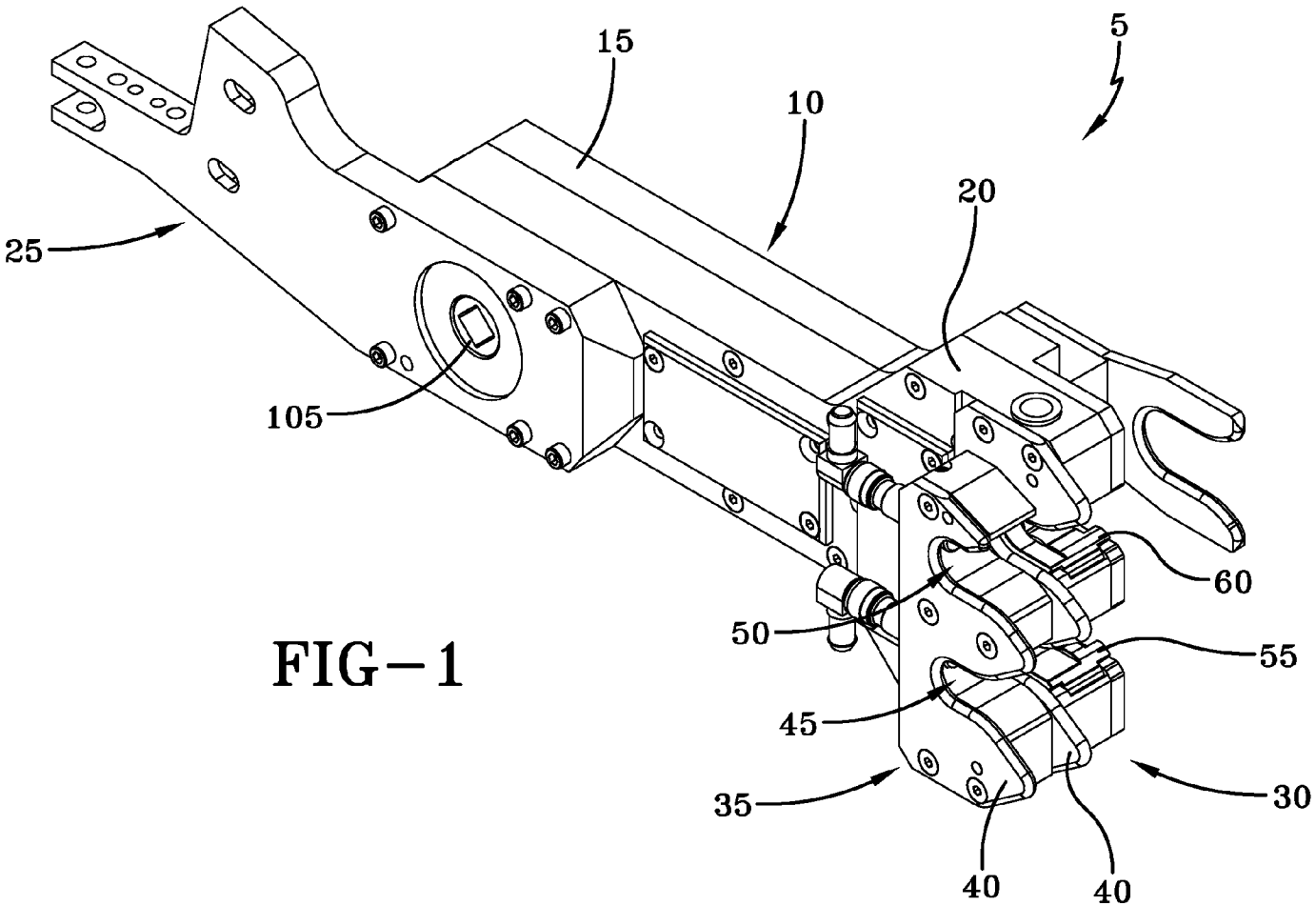
FIG. 1 is a slightly enlarged perspective view of one exemplary embodiment of a multi-wrench gear head apparatus of the present invention.
Figure 2:
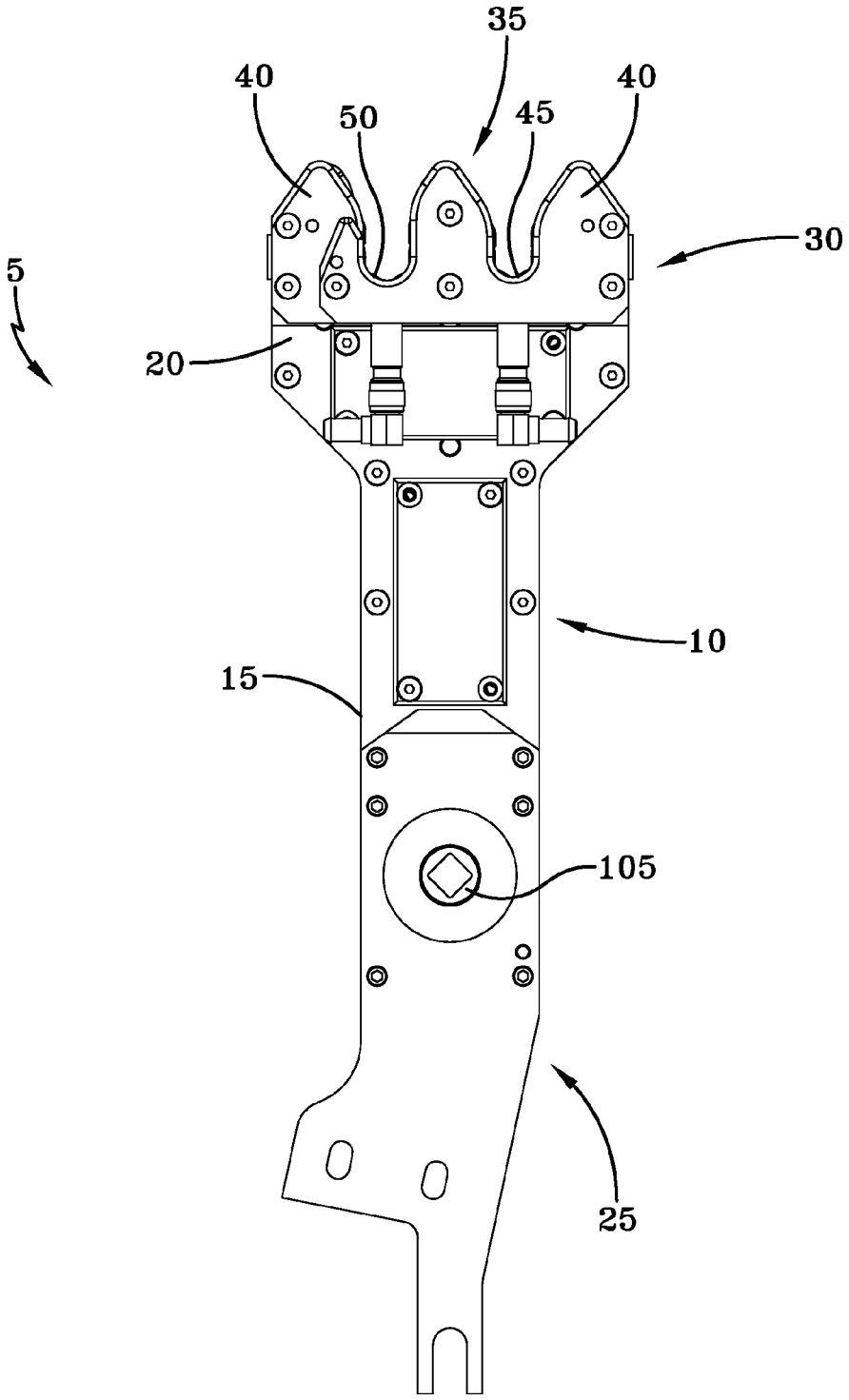
FIG. 2 is a front view of the exemplary multi-wrench gear head apparatus of FIG. 1.
Figure 3:
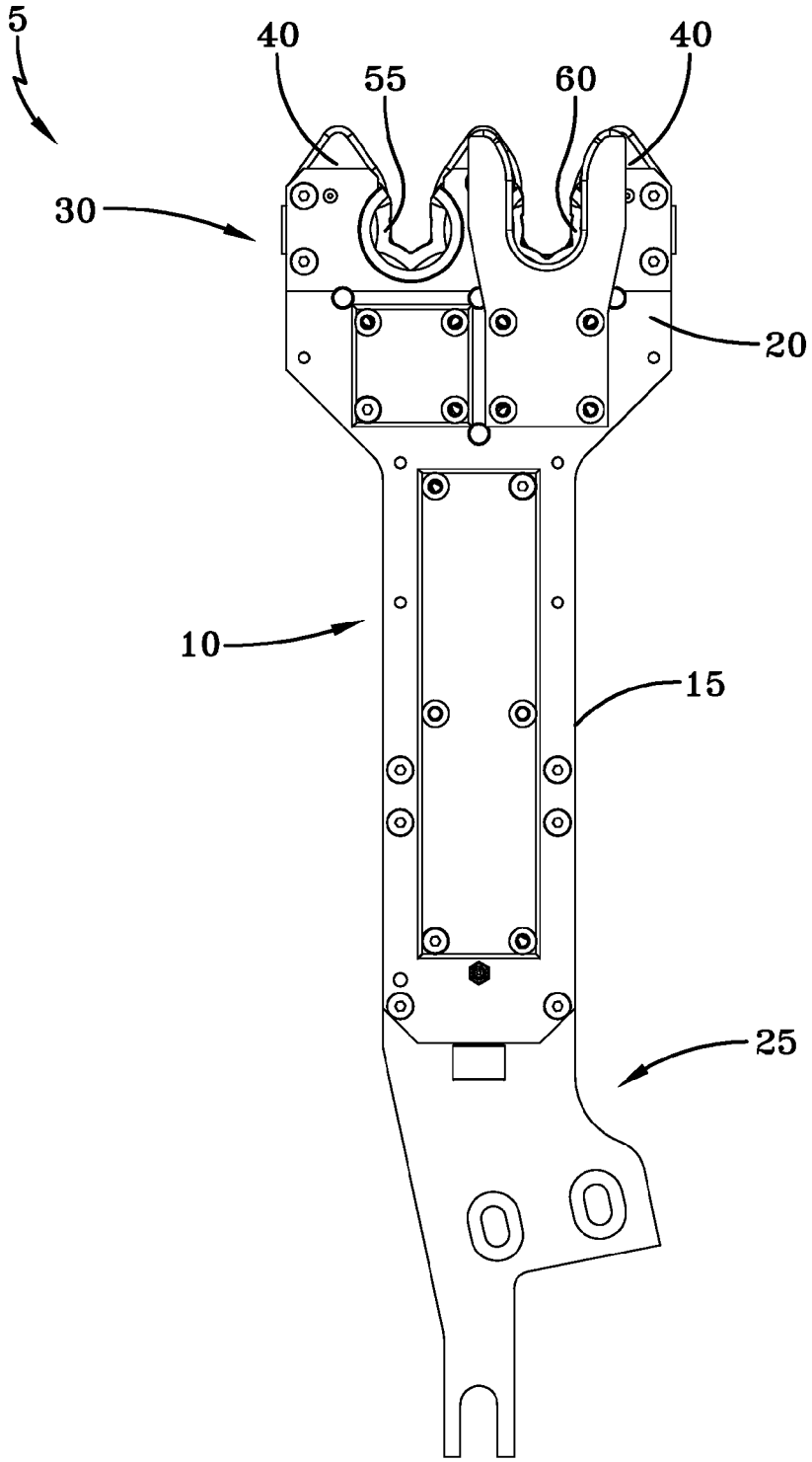
FIG. 3 is a rear view of the exemplary multi-wrench gear head apparatus of FIG. 1.
Figure 4:
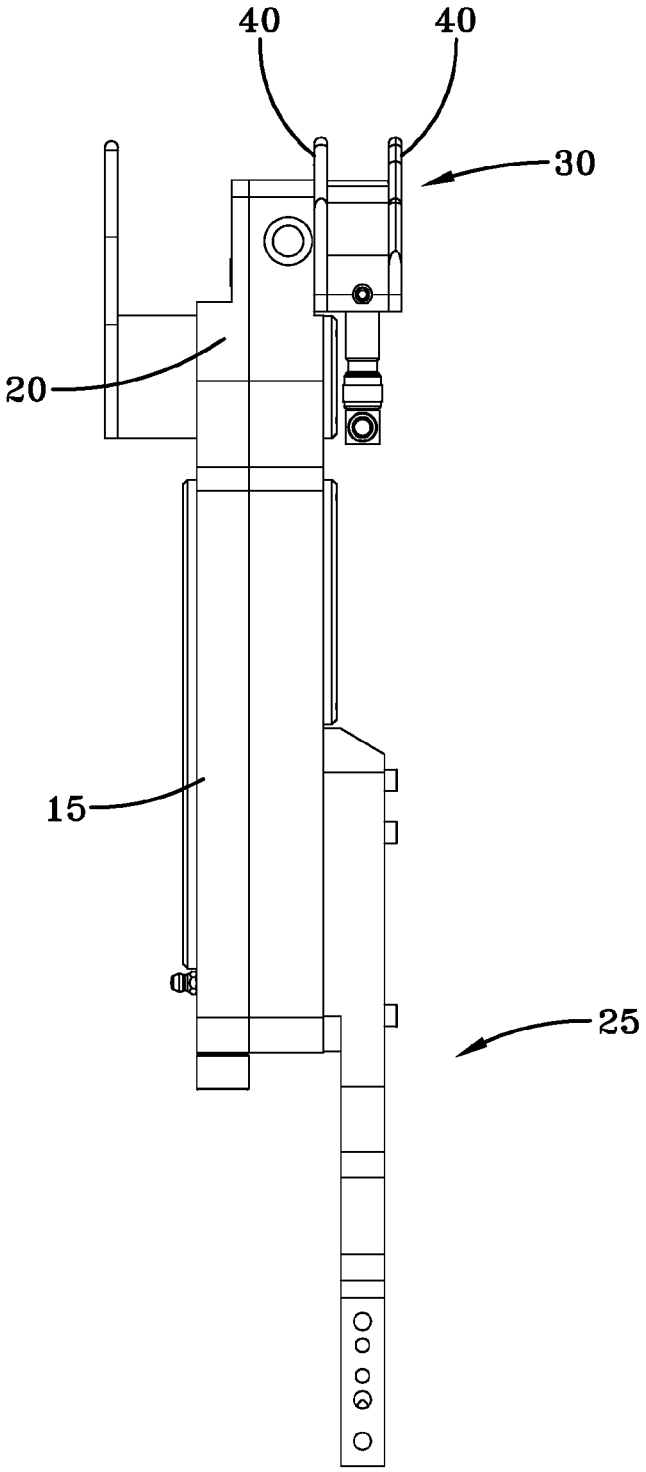
FIG. 4 is a left side view of the exemplary multi-wrench gear head apparatus of FIG. 1.
Figure 5:
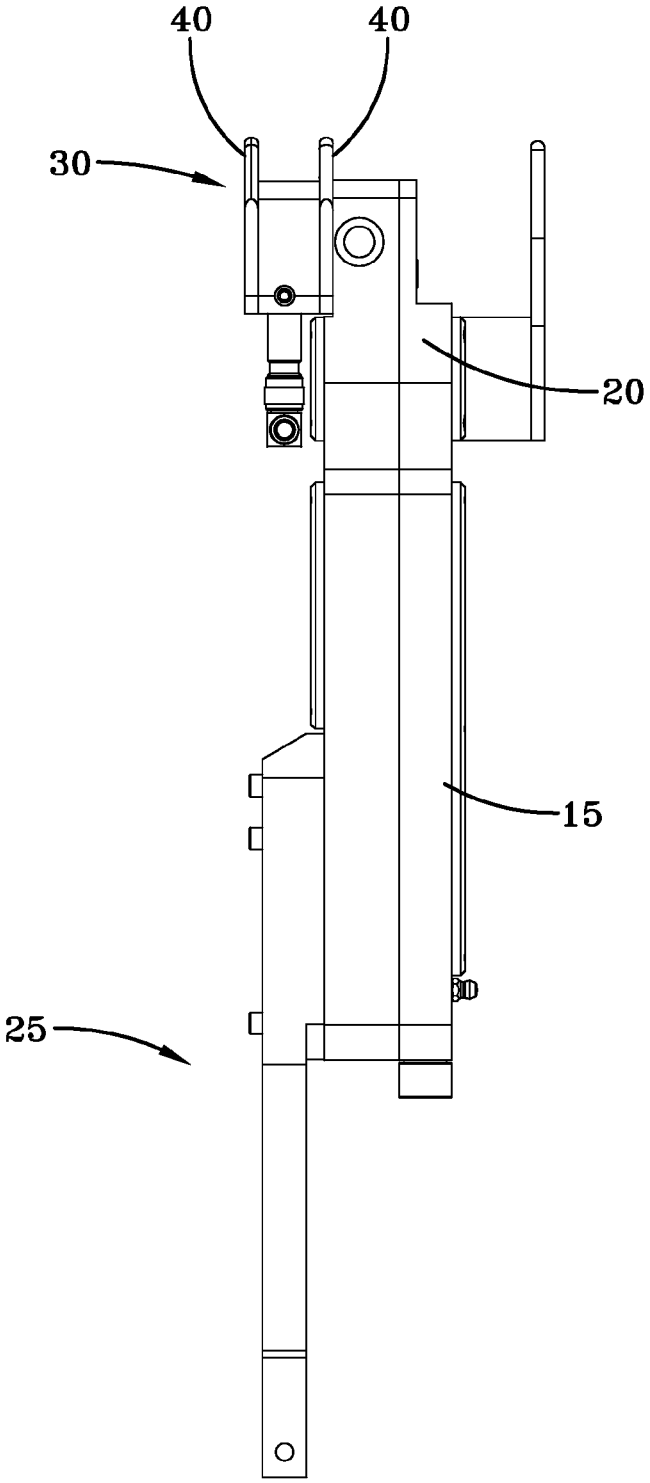
FIG. 5 is a right side view of the exemplary multi-wrench gear head apparatus of FIG. 1.

One exemplary embodiment of a multi-wrench gear head apparatus (hereinafter "apparatus") 5 of the present invention can be observed in FIGS. 1-7. An exterior view of the apparatus 5 is presented in FIGS. 1-5.

As shown, the apparatus 5 includes a housing 10 having an extension portion 15 and a gear head portion 20. The extension portion 15 is coupled to a connecting element 25. Associated with the gear head housing 20 of this particular exemplary embodiment is a dual gear head assembly 30. While a dual gear head assembly is shown and described below for purposes of illustration, it should be apparent to one of skilled in the art that embodiments of a multi-wrench gear head apparatus of the present invention may have more than two gear heads.

The dual gear head assembly 30 is shown to have a guide fork assembly 35 that includes a spaced pair of guide plates 40 that form two substantially U-shaped openings 45, 50. The U-shaped openings 45, 50 function to help guide the apparatus 5 into proper engagement with a tie-rod assembly of interest, as is described in more detail below.

Associated with and substantially adjacent each U-shaped opening 45, 50 is a rotatable socket 55, 60. The sockets 55, 60 are designed for presentation substantially as an open-end wrench, as would be familiar to one of skill in the art, and thus, the sockets from the wrench portions of the apparatus 5. The sockets are provided to independently engage and rotate a hex-shaped portion and a lock nut of an inner tie-rod of a tie-rod assembly of interest. For purposes of description only, the first U-shaped opening 45 and the first socket 55 will be referred to herein as being part of a first gear head of the dual gear head assembly 30, while the second U-shaped opening 50 and the second socket 60 will be referred to herein as being part of a second gear head of the dual gear head assembly.

The dual gear head assembly 30 allows the apparatus 5 to operate on tie-rods of two different sizes. In this particular embodiment, it can be seen that the first second U-shaped opening 50 is slightly larger than the first U-shaped opening 45, so as to accommodate an outer tie-rod of greater diameter. Similarly, but not as easily discernible from the drawing figures, the first socket 55 is of a different size than the second socket 60, so as to engage and rotate an inner tie-rod and lock nut of a size that cannot be engaged and rotated by the second socket. Typically, an outer tie-rod of greater diameter will be associated with an inner tie-rod having a larger hex portion and associated lock nut, but such is not necessarily the case. In alternate embodiments, it may also be possible that the outer tie-rods of interest are of the same diameter and, therefore, only the socket sizes are different. In the exemplary embodiment shown, the first gear head is used to adjust a tie-rod assembly having an inner tie-rod with a 14 millimeter hex portion, while the second gear head is used to adjust a tie-rod assembly having an inner tie-rod with a 17 millimeter hex portion (see FIG. 7).

During operation, the apparatus 5 would generally be moved into engagement with a tie-rod assembly of interest using a robot or other suitable actuator. Since this exemplary embodiment of the apparatus 5 is designed for use with a robot, the actuator will be referred to hereinafter as a robot, although it should be realized that other means of moving the apparatus into position are certainly also possible (e.g., pneumatic or hydraulic cylinders).

Based on the particular vehicle being manufactured, and its associated tie-rod size, the robot selects which of the two gear heads should be engaged with the tie-rod assembly and the socket portion thereof is normally positioned to operate on the lock nut, then the hex portion of the inner tie-rod, and then the lock nut, in a sequence that would be familiar to one of skill in the art. In order to operate on both a hex portion of an inner tie-rod, as well as a lock nut, a socket is typically of a double hex design. This feature is also well known in the art.

As described above, the socket of the gear head used to operate on the lock nut and inner tie-rod of a tie-rod assembly must be rotationally driven in order to effect a like rotation of the lock nut and inner tie-rod. Consequently, in the case of a multi-wrench gear head apparatus, each socket must be rotationally driven. In the case of the exemplary apparatus 5 described and shown herein then, both the first socket 55 and second socket 60 are so driven.

As should be apparent to one of skill in the art, providing a separate drive system for each socket of a multi-wrench gear head apparatus is undesirable for several reasons. First, such a construction would greatly increase the cost of the apparatus. Second, there are often significant space constraints associated with a tie-rod adjustment operation and, therefore, it is desirable that an apparatus used in such an operation be as compact as possible. As such, the use of separate drive systems might unacceptably increase the size of an apparatus of the present invention. Further, depending on the number of gear heads provided, the overall weight of such an apparatus may become an issue—although this will depend largely on the actuator with which the apparatus is associated.

To this end, a multi-wrench gear head apparatus of the present invention employs a shared gear train. This shared gear train allows each socket of a multi-wrench gear head apparatus to be driven from a single drive means and a single input gear. The use of a shared gear train thereby allows the overall size of a multi-wrench gear head apparatus of the present invention and the number of required components thereof to be minimized.

Figure 6:
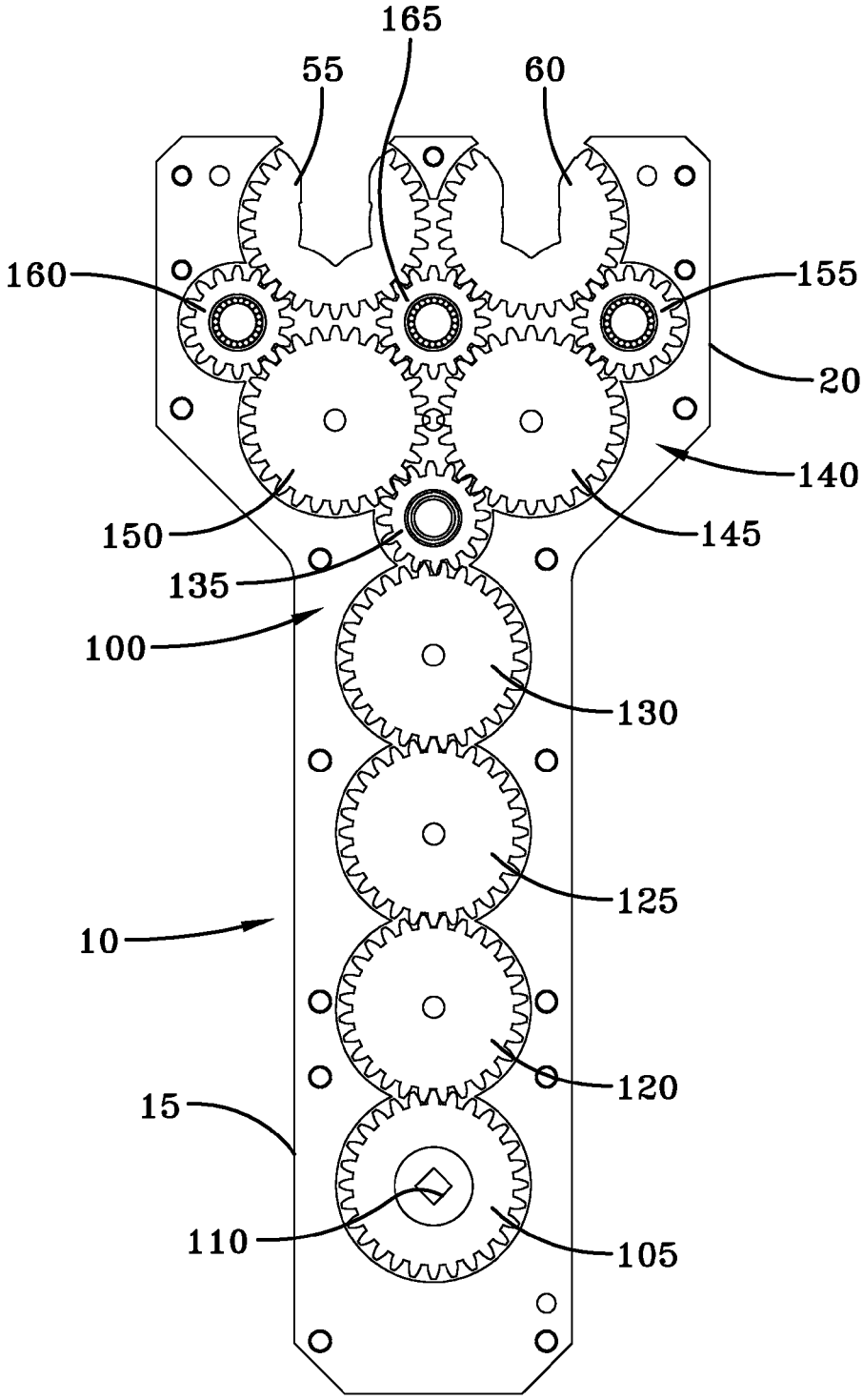
FIG. 6 is a transparent front view of a portion of the exemplary multi-wrench gear head apparatus of FIG. 1, wherein an internal gear train thereof is viewable.

An exemplary gear train 100 that may be used with the apparatus 5 of FIGS. 1-5 is illustrated in FIG. 6. As shown, the gear train 100 resides within the housing 10 and is operable to rotationally drive the sockets 55, 60. To this end, the gear train 100 includes a number of individual toothed gears that intermesh to transfer rotation of an input gear 105 to the sockets 55, 60. The input gear 105 is typically at least partially accessible through the housing 10 such that a drive means may be coupled thereto. The drive means may be of various types including, but not limited to, electric, pneumatic or hydraulic motors. It is also known in the art to drive a single gear head device with an electric nut runner, and the same technique may be employed with a multi-wrench gear head apparatus of the present invention. In this particular exemplary embodiment, the input gear 105 has an aperture 110 for receiving the drive shaft of a drive means (not shown).

Because this exemplary embodiment of the multi-wrench gear head apparatus 5 includes an elongated housing extension 15, the gear train 100 is designed to transfer the rotational motion of the input gear 105 to the gears located in the gear head 30. As such, this particular gear train 100 includes a number of linearly arranged transfer gears 120, 125, 130. While three transfer gears are depicted in this particular apparatus 5, it should be apparent to one of skill in the art that a greater or lesser number of transfer gears may be present in other embodiments.

The distal transfer gear 130 engages a transfer idler gear 135 that transfers the rotational motion of the transfer gears 120, 125, 130 to the gear head driving portion 140 of the gear train 100. A first socket coupling gear 145 and a second socket coupling gear 150 are rotationally driven by the transfer idler gear 135. In this particular embodiment, the socket coupling gears 145, 150 are of the same size as the transfer gears 120, 125, 130 so as to transfer the rotational motion of the transfer gears to the sockets 55, 60 without altering the speed thereof. As would be understood by one of skill in the art, however, other embodiments of a multi-wrench gear head apparatus of the present invention may employ gears of various size as required to produce a desired rotational velocity of the sockets.

As shown in FIG. 6, the first socket coupling gear 145 rotates a first socket drive gear 155 and the second socket coupling gear 150 rotates a second socket drive gear 160. As the first and second sockets 55, 60 are appropriately toothed, rotation of the first and second socket coupling gears 145, 150 produces a rotation of the first and second sockets via the first and second drive gears 155, 160. The first and second socket coupling gears 145, 150 and the first and second sockets 55, 60 also share a common idler gear 165. The common idler gear 165 is also driven by both the first and second socket coupling gears 145, 150 and assists with rotation of the first and second sockets 55, 60.

The combination of the first and second socket drive gears 155, 160 and the common idler gear 165 account for the open socket portion of the respective drive sockets 55, 60 and ensure that the socket drive gears are always engaged with a driven gear during rotation. For example, when the open socket portion of the first socket 55 passes the first socket drive gear, it can be understood that there may be a loss of engagement therebetween. Consequently, the presence of the common idler gear 165 ensures that the socket 50 remains in contact with a driven gear throughout its rotation. Proper rotation of the second socket gear 60 is ensured in the same manner.

In operation, a drive means is coupled to the input gear 105 and energized at the appropriate time to cause a rotation of the gear train 100. It can be understood from a review of FIG. 6 and the foregoing description that rotation of the gear train 100 causes a simultaneous rotation of both the first and second sockets 55, 60. Consequently, regardless of the socket to be used, driven rotation thereof is provided.

Figure 7:
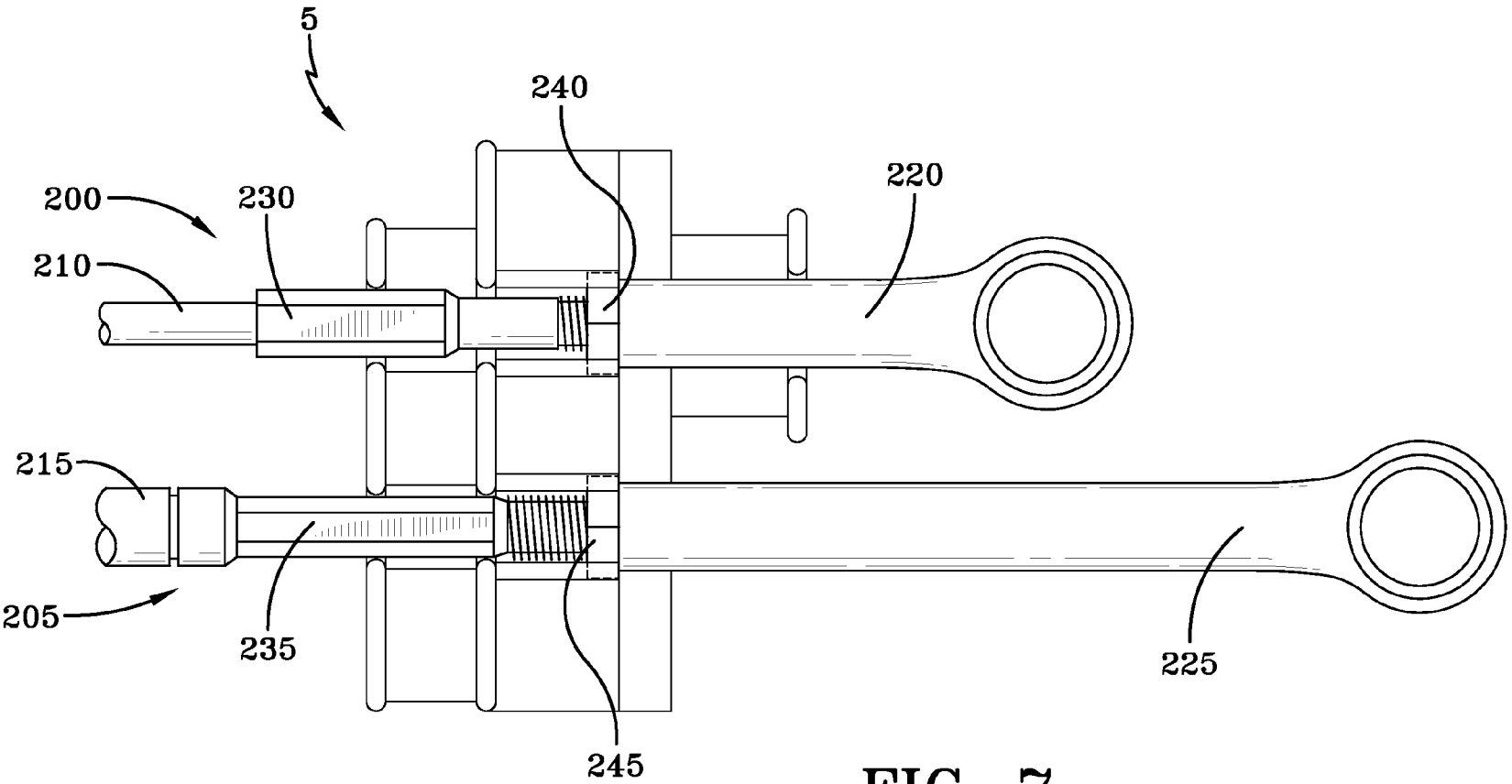
FIG. 7 depicts an exemplary apparatus of the present invention concurrently engaged with two tie-rod assemblies of different size.

The exemplary apparatus 5 of the present invention is shown in FIG. 7 to be concurrently engaged with two exemplary tie-rod assemblies 200, 205 of different size. As would be readily understood, the apparatus 5 of FIG. 7 is shown to be concurrently engaged with the two tie-rod assemblies 200, 205 for purposes of illustration only, and FIG. 7 is not to be interpreted as implying that the apparatus operates simultaneously on two different tie-rod assemblies. As can be seen in FIG. 7, each of the tie-rod assemblies 200, 205 comprises a respective inner tie-rod 210, 215 and a respective outer tie-rod 220, 225. Each of the inner tie-rods 210, 215 includes a respective hex-shaped portion 230, 235 and a corresponding lock nut 240, 245. As shown in FIG. 7, the larger inner tie-rod 210 has a 17 millimeter hex-shaped portion 230 while the smaller inner tie-rod 215 has a 14 millimeter hex-shaped portion 235. These inner tie-rod dimensions are provided solely for illustration and, as should be obvious, apparatus of the present invention may be used with tie rods having dimensions different than those shown herein.

Notably, a multi-wrench gear head apparatus of the present invention, such as the apparatus 5 illustrated in FIGS. 1-7, is able to provide driven rotation of all the gear heads present from a single drive means. Thus, the overall cost and size of a given apparatus can be minimized. While a dual gear head apparatus has been described above and shown in the drawing figures for purposes of illustration, an apparatus having a greater number of gear heads may also be constructed. In such a case, the gear head portion of the gear train would simply be expanded as necessary to impart rotation to each gear head. Such a modification would be well within the knowledge and capabilities of one skilled in the art in light of the disclosure provided herein. Other modifications are also possible. For example, and without limitation, two or more wrench portions of an apparatus of the present invention may be provided with sockets of the same size so as to operate on tie-rod assemblies of the same size. Such an alternate design may be desirable for a number of reasons, including space constraint and redundancy reasons.

Therefore, while certain embodiments of the present invention are described in detail above, it is to be understood that the scope of the invention is not to be considered limited by such disclosure, and modifications are possible without departing from the spirit of the invention as evidenced by the following claims:

What is claimed is:

1. A multi-wrench gear head apparatus for adjusting vehicle tie-rod assemblies, said apparatus comprising:

a plurality of wrench portions associated with a gear head of said apparatus, each wrench portion comprising a geared socket for engaging and adjusting a tie-rod assembly;

a shared gear train having an input gear provided to be rotationally driven by a drive means, said gear train including a transfer idler gear for transferring rotational motion from said input gear to each geared socket of said gear head via a combination of a socket coupling gear and a socket drive gear, a common idler gear also shared by adjacent pairs of socket coupling gears and associated sockets;

wherein each socket present is concurrently driven in a like direction by said shared gear train.

2. The apparatus of claim 1, further comprising a guide fork associated with and located adjacent each wrench portion, said guide fork for engaging an outer tie-rod of a tie-rod assembly during a tie-rod assembly adjustment operation.

3. The apparatus of claim 1, wherein each geared socket is designed to engage a shaped portion and a lock nut of an inner tie-rod of a tie-rod assembly and is operative to selectively and independently rotate said inner tie-rod and said lock nut to adjust the overall length of the associated tie-rod assembly.

4. The apparatus of claim 1, further comprising a plurality of linearly arranged transfer gears located between said input gear and said transfer idler gear.

5. The apparatus of claim 1, wherein each socket is of a different size, so as to engage tie-rod assembly inner tie-rods or lock nuts of dissimilar size.

6. The apparatus of claim 1, wherein said input gear, said transfer gear(s) and said socket coupling gears are of the same size so as not to alter the rotational speed imparted by the input gear.

7. The apparatus of claim 1, wherein one or more of said input gear, said transfer gear(s) and said socket coupling gears are of different size so as to alter the rotational speed imparted by the input gear.

8. The apparatus of claim 1, wherein dual wrench portions are present.

9. A multi-wrench gear head apparatus for adjusting vehicle tie-rod assemblies, said apparatus comprising:

a plurality of wrench portions associated with a gear head of said apparatus, each wrench portion comprising a geared socket for engaging a shaped portion and a lock nut of a tie-rod assembly inner tie-rod and for selectively and independently rotating said inner tie-rod and said lock nut to adjust the overall length of the associated tie-rod assembly; and a shared gear train having an input gear provided to be rotationally driven by a drive means, said gear train including a transfer idler gear for transferring rotational motion from said input gear to each geared socket of said gear head via a combination of a socket coupling gear and a socket drive gear, a common idler gear also shared by adjacent pairs of socket coupling gears and associated sockets;

wherein each socket present is concurrently driven in a like direction by said gear train and a single drive means.

10. The apparatus of claim 9, further comprising a guide fork associated with and located adjacent each wrench portion, said guide fork for engaging an outer tie-rod of a tie-rod assembly during a tie-rod assembly adjustment operation.

11. The apparatus of claim 9, further comprising a plurality of linearly arranged transfer gears located between said input gear and said transfer idler gear.

12. The apparatus of claim 9, wherein each socket is of a different size, so as to engage inner tie-rods or lock nuts of dissimilar size.

13. The apparatus of claim 9, wherein said input gear, said transfer gear(s) and said socket coupling gears are of the same size so as not to alter the rotational speed imparted by the input gear.

14. The apparatus of claim 9, wherein one or more of said input gear, said transfer gear(s) and said socket coupling gears are of different size so as to alter the rotational speed imparted by the input gear.

15. The apparatus of claim 9, wherein dual wrench portions are present.

16. A dual-wrench gear head apparatus for adjusting tie-rod assemblies of different vehicles, said apparatus comprising:

a pair of wrench portions associated with a gear head of said apparatus, each wrench portion comprising a geared socket of different size for engaging a shaped portion and a lock nut of an inner tie-rod of a tie-rod assembly of interest and for selectively and independently rotating said inner tie-rod and said lock nut to adjust the overall length of the associated tie-rod assembly; and a shared gear train having an input gear provided to be rotationally driven by a single drive means, said gear train including a transfer idler gear for transferring rotational motion from said input gear to both of said geared sockets of said gear head, said transfer idler gear arranged to rotate a pair of socket coupling gears which, in turn, rotate a pair of socket drive gears and a common idler gear, said socket drive gears and said common idler gear working, in combination, to concurrently rotate said sockets in a like direction.

17. The apparatus of claim 16, further comprising a guide fork associated with and located adjacent each wrench portion, said guide fork for engaging an outer tie-rod of a tie-rod assembly during a tie-rod assembly adjustment operation.

18. The apparatus of claim 16, further comprising a plurality of linearly arranged transfer gears located between said input gear and said transfer idler gear.

19. The apparatus of claim 16, wherein said input gear, said transfer gear(s) and said socket coupling gears are of the same size so as not to alter the rotational speed imparted by the input gear.

20. The apparatus of claim 16, wherein one or more of said input gear, said transfer gear(s) and said socket coupling gears are of different size so as to alter the rotational speed imparted by the input gear.

21. A method of adjusting the length of a vehicle tie-rod assembly, comprising:

(a) providing a multi-wrench gear head apparatus, said apparatus further comprising:

a plurality of wrench portions associated with a gear head of said apparatus, each wrench portion comprising a geared socket for engaging a shaped portion and a lock nut of a tie-rod assembly inner tie-rod and for selectively and independently rotating said inner tie-rod and said lock nut to adjust the overall length of the associated tie-rod assembly, and a shared gear train having an input gear provided to be rotationally driven by a drive means, said gear train including a transfer idler gear for transferring rotational motion from said input gear to each geared socket of said gear head via a combination of a socket coupling gear and a socket drive gear, a common idler gear also shared by adjacent pairs of socket coupling gears and associated sockets, such that each socket of said gear head is concurrently driven in a like direction by said gear train and a single drive means, (b) associating said multi-wrench gear head apparatus with an actuator for moving said multi-wrench gear head apparatus between a resting position and a tie-rod assembly engaging position;

(c) using said actuator to move a selected wrench portion of said multi-wrench gear head apparatus into engagement with a tie-rod assembly of interest; and (d) activating a single drive means associated with said multi-wrench gear head apparatus to concurrently rotate each socket of said gear head in a like direction;

whereby rotation of the socket of said wrench portion engaged with said tie-rod assembly is operative to adjust the length of said tie-rod assembly.

22. The method of claim 21, wherein said actuator moves said selected wrench portion of said multi-wrench gear head apparatus between engagement with a shaped portion of an inner tie-rod of said tie-rod assembly and a lock nut associated therewith.

* * * * *